US010850288B2

(12) United States Patent
Casa et al.

(10) Patent No.: US 10,850,288 B2
(45) Date of Patent: Dec. 1, 2020

(54) CENTRIFUGAL SEPARATOR WITH FEED PIPE HAVING SPIRAL GROOVES

(71) Applicant: ANDRITZ Frautech S.r.l., Schio (IT)

(72) Inventors: Daniele Casa, Schio (IT); Damon Cecchellero, Piovene Rocchette (IT)

(73) Assignee: Andritz Frautech S.r.l., Schio (IT)

( * ) Notice: Subject to any disclaimer, the term of this patent is extended or adjusted under 35 U.S.C. 154(b) by 421 days.

(21) Appl. No.: 15/822,547

(22) Filed: Nov. 27, 2017

(65) Prior Publication Data

US 2018/0147582 A1 May 31, 2018

(30) Foreign Application Priority Data

Nov. 30, 2016 (EP) ..... 16201448

(51) Int. Cl.
*B04B 11/02* (2006.01)
*B04B 1/08* (2006.01)

(52) U.S. Cl.
CPC ..... *B04B 11/02* (2013.01); *B04B 1/08* (2013.01)

(58) Field of Classification Search
CPC ..... B04B 11/02; B04B 1/08
USPC ..... 494/66, 70
See application file for complete search history.

(56) References Cited

U.S. PATENT DOCUMENTS 1,906,457 A * 5/1933 Flowers ..... B04B 11/06 494/66
2,301,110 A * 11/1942 Clayton ..... B01D 11/048 554/203
2007/0270298 A1* 11/2007 Wieking ..... B04B 1/08 494/70

FOREIGN PATENT DOCUMENTS

WO WO-2007104455 A1 * 9/2007 ..... B04B 11/06

* cited by examiner

*Primary Examiner* — Walter D. Griffin
*Assistant Examiner* — Shuyi S. Liu
(74) *Attorney, Agent, or Firm* — Alix, Yale & Ristas, LLP

(57) ABSTRACT

A centrifugal separator, especially disc stack separator for separation of a suspension or mixture, has a feeding unit with an inlet and a stationary pipe. The pipe extends longitudinally from the top of the centrifugal separator through a stack of filter discs and has an opening directed to the accelerator disc a separator bowl of the centrifugal separator. The feed pipe is corrugated with spiral grooves running in the longitudinal direction of the pipe. The suspension flow is directed in the direction of rotation of the separator bowl and a soft infeed of the suspension to the accelerator disc and bowl without mechanically destroying particles or molecules of the suspension or mixture is achieved.

20 Claims, 3 Drawing Sheets

CENTRIFUGAL SEPARATOR WITH FEED PIPE HAVING SPIRAL GROOVES

BACKGROUND

The disclosed embodiments are related to a centrifugal separator, especially disc stack separator, for separation of a suspension or mixture comprising a feed unit with an inlet and a stationary pipe, whereby the pipe extends from the top of the separator through the stack of filter discs and the opening is directed to the accelerator disc of the separator bowl.

A centrifugal separator, especially a disc stack separator comprises a feed pipe for the solid/liquid mixture, a stack of filter discs, a bowl and an outlet for the separated fractions. The solid/liquid mixture is directed by the feed pipe to a so called accelerator disc which directs the mixture into the rotating bowl. While the feed pipe is stationary the accelerator or accelerator disc and the bowl rotate normally at a speed of up to 15,000 rpm. In the disc stack, which is also rotating, the mixture is separated into a light fraction and a heavy fraction. The light fraction is transported by a centrifugal pump through a channel in the rotating shaft upwards and discharged through a discharge pipe. The heavy fraction is discharged through nozzles in the wall of the bowl in case of a nozzle separator. Due to the rotation the light fraction concentrates in the center and the heavy fraction is sent to the circumference.

Feed units with pipes are widely used in centrifugal separators. However when the liquid or mixture is flowing out at the bottom of the pipe it is directed to the center of the rotating accelerator disc mounted in the bowl. In case of high concentrated mineral suspension to be separated the liquid will wear the accelerator top due to the velocity and impingement force. Also there is a high energy loss due to such impingement. However, such wear and energy loss will also exist with other suspensions or even with emulsions, especially in all the food processes, e.g. in dairy industry. In general, the feed units and feed pipes will be stationary while the accelerator disc together with the disc stack and the bowl will rotate.

The disclosed embodiments aim to eliminate the drawback of the known feeding units.

In embodiments of the disclosed device, the feed pipe is corrugated with spiral grooves running in the longitudinal direction of the pipe. With this design the suspension flow is directed to the accelerator disc with a flow component in radial and in tangential direction. Therefore, the suspension no longer has to be accelerated in a tangential direction from zero by the accelerator disc, and thus the necessary energy consumption of the centrifugal separator can be reduced.

Due to the grooves, the fluid is accelerated in a radial and circumferential (tangential) direction. Thus, the fluid flow is already in the direction of the rotating accelerator disc and bowl. This also leads to a soft infeed of the suspension to the accelerator and bowl without mechanical destruction of particles or molecules of the feed suspension or mixture.

Also by providing a corrugated pipe, it is only one part that is more easily manufactured. A preferred embodiment includes a groove in the pipe with a pitch within the range of 20 mm to 250 mm, and preferably approximately 150 mm. With a pitch within this range, it has proven to lead to the optimal speed and direction of the suspension or liquid fed in relation to the separation.

Another advantageous embodiment includes grooves with a depth within the range of 2 mm to 20 mm. With such depth of the grooves an optimum of throughput is achieved.

SUMMARY

In one embodiment, a centrifugal separator for separation of a suspension or mixture has a longitudinally extending feed pipe, a separator bowl and a stack of filter discs. The pipe extends from a top portion of the separator through a stack of filter discs and has an opening directed toward an accelerator disc of the separator bowl. The feed pipe is corrugated with spiral grooves running in the longitudinal direction. The spiral grooves direct flow of the suspension or mixture in a radial and tangential direction.

In another embodiment, a centrifugal separator has a lower separator bowl, a plurality of filter discs and a feed pipe. The lower separator bowl includes an accelerator disc that defines a longitudinal axis positioned therein. The filter discs are positioned in a stacked configuration between a top portion of the separator and the accelerator disc substantially coaxial to the accelerator disc. The feed pipe extends longitudinally coaxial to the accelerator disc and filter discs from a proximal end at the top portion of the separator through the filter discs to an open distal end above the accelerator disc. The feed pipe is corrugated with spiral grooves running in the longitudinal direction to direct flow of suspension or mixture in a radial and tangential direction.

BRIEF DESCRIPTION OF THE DRAWING

The invention is now described in detail with regard to the drawings where.

DETAILED DESCRIPTION

Figure 1:
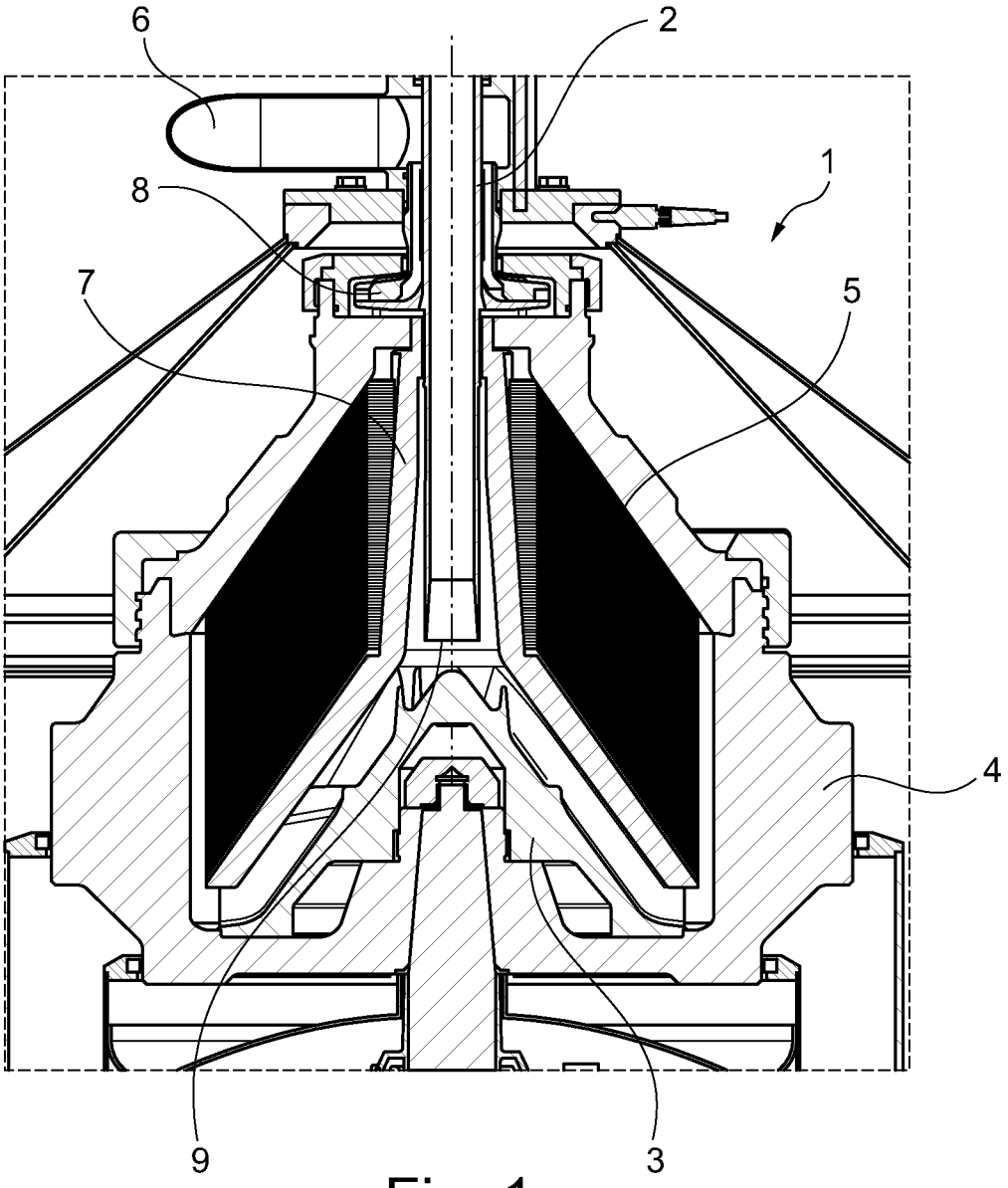
FIG. 1 shows a section of a separator, especially a nozzle separator, that utilizes the disclosed device.

FIG. 1 shows a nozzle separator 1, as a special design of a disc stack separator, with a feed pipe 2 for the separation of a solid/liquid mixture. This mixture is directed to a so called accelerator disc 3 which directs the mixture into the rotating bowl 4. While the feed pipe 2 is stationary, the accelerator or accelerator disc 3 and bowl 4 rotate at a high speed of 4,000 rpm and up to 15,000 rpm. In the disc stack 5, which is also rotating, the mixture is separated into a light fraction which is discharged through discharge pipe 6 and a heavy fraction which is discharged through nozzles arranged in the wall of the bowl 4 in case of a nozzle separator. Due to the rotation, the light fraction concentrates in the center and the heavy fraction is sent to the circumference. The suspension or mixture is introduced into the centrifugal separator through feed pipe 2 which is arranged in the hollow shaft of the distributor 7 carrying the disc stack 5 where the light fraction is pumped upwards through a channel in the distributor 7 by a centrifugal pump 8 to the discharge pipe 6. The feed pipe 2 extends from the top of the separator through the stack of filter discs 5 and the opening 9 of the feed pipe 2 is directed to the accelerator disc 3 of the separator bowl 4.

Figure 2:
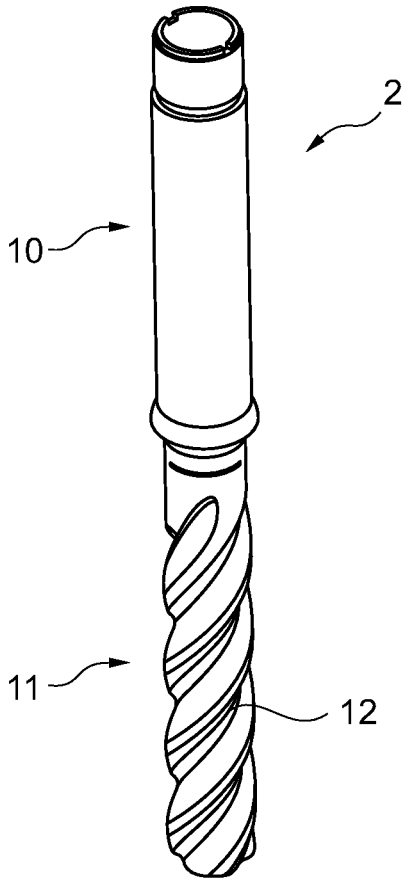
FIG. 2 shows a view of the disclosed feed pipe.

FIG. 2 shows a preferred embodiment of the feed pipe 2. The feed pipe 2 comprises an upper part 10 which is straight and a lower part 11 which has spiral grooves 12. The straight upper part 10 is used to mount it into existing separators. In this way it is easy to exchange an existing feed pipe, which is totally straight, with a new feed pipe like that shown as reference numeral 2. It is also possible to use feed pipes with different depth and pitch of the groove 12 to adapt the separator for use for different mixtures or suspensions. The grooves 12 in the lower part 11 are corrugated into the pipe. So it is easy to manufacture as a single part only.

Figure 3:
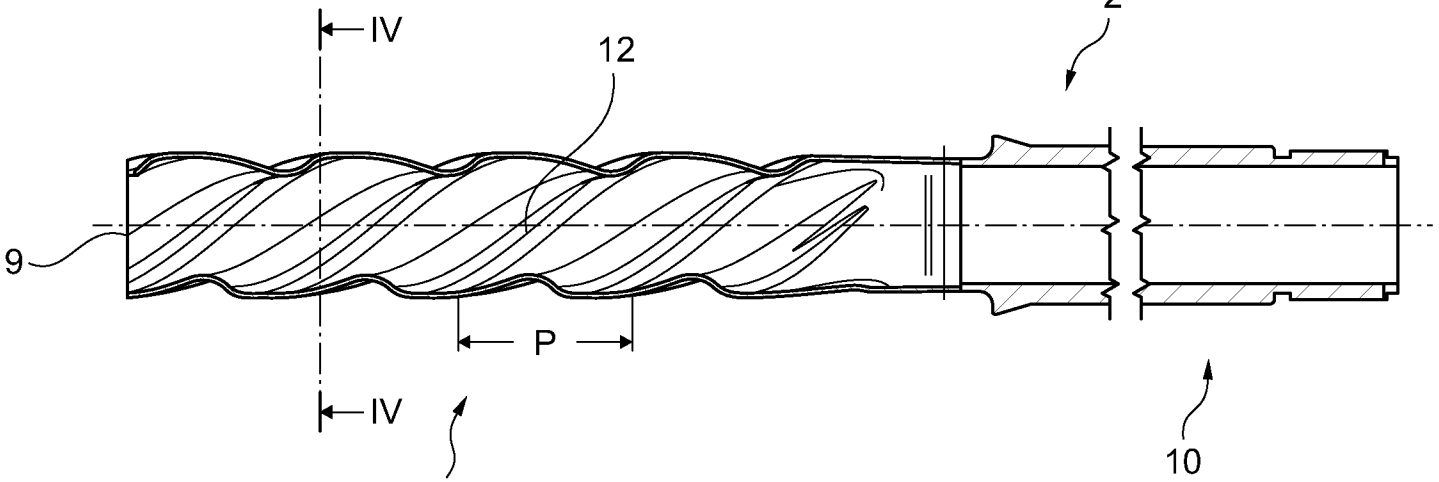
FIG. 3 shows a longitudinal section of the disclosed feed pipe.

FIG. 3 shows the longitudinal section of the preferred embodiment of the feed pipe 2. The straight upper part 10 has been cut in this view to concentrate on the new lower part 11. However both parts preferably have a similar length. In this example, three grooves 12 are provided. Pitch p of the grooves is within the range of 20 mm to 250 mm to give a proper radial and tangential direction of the suspension or mixture jet at the opening 9 of the feed pipe 2. In addition due to this spiral effect, the jet is spread after leaving the feed pipe. This will minimize the wear of the accelerator disc and also minimize the energy loss. In addition, the molecules of the suspension, especially in food processes, will not be smashed.

Figure 4:
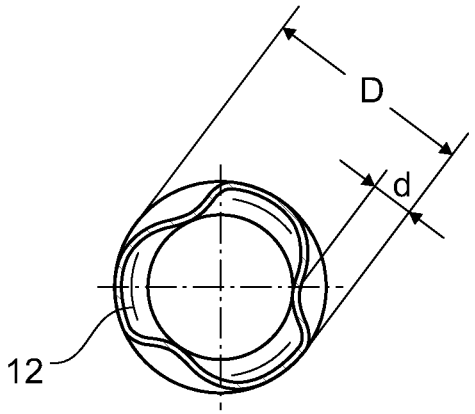
FIG. 4 shows a cross section of the disclosed feed pipe

In FIG. 4 a cross section along line IV-IV in FIG. 3 is shown. Here the three grooves 12 can be clearly seen. Further the depth d of the grooves in relation to the outer diameter D of the feed pipe is shown, where a depth d within the range of 2 mm to 20 mm has proven favorable. In general, the number of grooves, depth and width depend on the properties of the suspension or mixture to be separated and the operational data, e.g. throughput, rotational speed, etc., can be selected accordingly to reach an optimum for a particular operation.

Although the present disclosure has been described and illustrated in detail, it is to be clearly understood that this is done by way of example and not limitation. For example, the grooves can also have different cross-sectional shapes, such as a square or rectangular cross section, or the length of the upper part and lower part may be quite different depending on the situation in, e.g. an existing separator.

The invention claimed is:

1. A centrifugal separator (1) for separation of a suspension or mixture having a feeding unit with an inlet, comprising:

a longitudinally extending feed pipe (2) extending from a top portion of the centrifugal separator (1) through a stack of filter discs (5), the pipe having an opening (9) directed toward an accelerator disc (3) of a separator bowl (4) of the centrifugal separator (1), wherein the feed pipe (2) is corrugated with spiral grooves (12) running in the longitudinal direction to direct the flow of suspension or mixture in a radial and tangential direction.

2. The centrifugal separator of claim 1, wherein the grooves (12) in the pipe (2) have a pitch (p) within the range of 20 mm to 250 mm.

3. The centrifugal separator of claim 2, wherein the pitch (p) is approximately 150 mm.

4. The centrifugal separator of claim 1, wherein the grooves (12) have a depth (d) of within the range of 2 mm to 20 mm.

5. The centrifugal separator of claim 2, wherein the grooves (12) have a depth (d) of within the range of 2 mm to 20 mm.

6. The centrifugal separator of claim 1, wherein the pipe (2) has three spiral grooves (12).

7. The centrifugal separator of claim 2, wherein the pipe (2) has three spiral grooves (12).

8. The centrifugal separator of claim 4, wherein the pipe (2) has three spiral grooves (12).

9. The centrifugal separator of claim 5, wherein the pipe (2) has three spiral grooves (12).

10. The centrifugal separator of claim 1, wherein the centrifugal separator is a disc stack separator.

11. A centrifugal separator (1) for separation of a suspension or mixture having a feeding unit with an inlet, comprising:

a lower separator bowl (4) with an accelerator disc (3) positioned therein, the accelerator disc (3) defining a longitudinal axis;

a plurality of filter discs (5) positioned in a stacked configuration between a top portion of the separator (1) and the accelerator disc (3), the filter discs (5) being substantially coaxial to the accelerator disc (3);

a feed pipe (2) extending longitudinally coaxial to the accelerator disc (3) and filter discs (5) from a proximal end at the top portion of the separator (1) through the filter discs (5) to an open distal end above the accelerator disc (3), wherein the feed pipe (2) is corrugated with spiral grooves (12) running in the longitudinal direction to direct to the flow of suspension in a radial and tangential direction.

12. The centrifugal separator of claim 11, wherein the grooves (12) in the pipe (2) have a pitch (p) within the range of 20 mm to 250 mm.

13. The centrifugal separator of claim 12, wherein the pitch (p) is approximately 150 mm.

14. The centrifugal separator of claim 11, wherein the grooves (12) have a depth (d) of within the range of 2 mm to 20 mm.

15. The centrifugal separator of claim 12, wherein the grooves (12) have a depth (d) of within the range of 2 mm to 20 mm.

16. The centrifugal separator of claim 11, wherein the pipe (2) has three spiral grooves (12).

17. The centrifugal separator of claim 12, wherein the pipe (2) has three spiral grooves (12).

18. The centrifugal separator of claim 14, wherein the pipe (2) has three spiral grooves (12).

19. The centrifugal separator of claim 15, wherein the pipe (2) has three spiral grooves (12).

20. The centrifugal separator of claim 11, wherein the centrifugal separator is a disc stack separator.

* * * * *